US008235226B2

(12) United States Patent
Crawbuck et al.

(10) Patent No.: US 8,235,226 B2
(45) Date of Patent: Aug. 7, 2012

(54) INTEGRATED SHELF ALLOCATION MANAGEMENT SYSTEM

(75) Inventors: Cynthia A. Crawbuck, Wexford, PA (US); James R. Burchell, Clairton, PA (US); Edward J. Moss, Pittsburgh, PA (US); John C. Burchell, North Versailles, PA (US)

(73) Assignee: Smart Systems, Inc., Pittsburgh, PA (US)

( * ) Notice: Subject to any disclaimer, the term of this patent is extended or adjusted under 35 U.S.C. 154(b) by 0 days.

(21) Appl. No.: 12/644,659

(22) Filed: Dec. 22, 2009

(65) Prior Publication Data

US 2010/0096345 A1 Apr. 22, 2010

Related U.S. Application Data

(62) Division of application No. 11/846,355, filed on Aug. 28, 2007, now Pat. No. 8,066,128.

(51) Int. Cl.
*A47F 1/04* (2006.01)
*A47F 7/00* (2006.01)

(52) U.S. Cl. ..... 211/59.3; 211/59.2

(58) Field of Classification Search ..... 211/59.3, 211/59.2, 184, 175, 126.6, 130.1, 132.1, 211/133.6; 312/35, 73, 42, 43, 45, 61, 71, 312/72, 334.5; 108/61

See application file for complete search history.

(56) References Cited

U.S. PATENT DOCUMENTS

| | | | | |
|---|---|---|---|---|
| 202,230 | A | 4/1878 | Chapman | |
| 779,262 | A | 1/1905 | Burke | |
| 3,119,644 | A * | 1/1964 | Workman | 384/20 |
| 3,887,102 | A | 6/1975 | Earley | |
| 4,036,369 | A | 7/1977 | Eisenberg | |
| 4,155,312 | A | 5/1979 | Thorkildson | |
| 4,179,091 | A * | 12/1979 | Bidney | 248/265 |
| 4,478,337 | A | 10/1984 | Flum | |
| 4,564,118 | A | 1/1986 | Heyer et al. | |
| 4,589,349 | A | 5/1986 | Gebhardt et al. | |
| 4,627,542 | A | 12/1986 | Fredrickson | |
| 4,724,968 | A | 2/1988 | Wombacher | |
| 5,044,589 | A * | 9/1991 | Milne et al. | 248/265 |
| 5,096,272 | A | 3/1992 | Belokin, Jr. et al. | |
| 5,306,080 | A * | 4/1994 | Lautenschlager et al. | 312/334.5 |
| 5,366,099 | A | 11/1994 | Schmid | |
| 5,413,229 | A | 5/1995 | Zuberbuhler et al. | |
| 5,458,248 | A | 10/1995 | Alain | |
| 5,469,976 | A * | 11/1995 | Burchell | 211/59.3 |
| 5,806,690 | A | 9/1998 | Johnson et al. | |
| 6,349,911 | B1 | 2/2002 | Feldpausch et al. | |
| 6,375,015 | B1 | 4/2002 | Wingate | |
| 6,523,702 | B1 | 2/2003 | Primiano et al. | |

(Continued)

FOREIGN PATENT DOCUMENTS

GB 2185369 A 7/1987

*Primary Examiner* — Darnell Jayne
*Assistant Examiner* — Andres F Gallego
(74) *Attorney, Agent, or Firm* — Reed Smith LLP

(57) ABSTRACT

Apparatuses for the efficient and safe organization of product on shelves. The backstop assemblies are capable of being utilized in a wide variety of shelving units. Because the backstop puller engages the front of the backstop, the backstop assemblies are able to be employed in shelves of various depths and allow for the customer to draw product toward the front of the shelving unit efficiently.

3 Claims, 13 Drawing Sheets

U.S. PATENT DOCUMENTS

| | | | | |
|---|---|---|---|---|
| 6,557,960 | B2 * | 5/2003 | Shih | 312/334.5 |
| 6,615,995 | B2 | 9/2003 | Primiano et al. | |
| 6,685,037 | B1 | 2/2004 | Zadak | |
| 6,695,152 | B1 | 2/2004 | Fabrizio et al. | |
| 6,749,277 | B2 * | 6/2004 | Michaels | 312/334.5 |
| 6,779,670 | B2 | 8/2004 | Primiano et al. | |
| 6,994,300 | B2 | 2/2006 | Labeirie et al. | |
| D565,322 | S | 4/2008 | Mason | |
| 7,424,957 | B1 * | 9/2008 | Luberto | 211/59.3 |
| 7,458,473 | B1 | 12/2008 | Mason | |
| 7,625,051 | B1 * | 12/2009 | Kim | 312/334.5 |
| 2003/0132181 | A1 | 7/2003 | Saulnier-Matteini | |
| 2004/0011754 | A1 | 1/2004 | Zadak | |
| 2004/0200789 | A1 | 10/2004 | Woodbury | |
| 2004/0245197 | A1 | 12/2004 | McElvaney | |
| 2005/0016112 | A1 * | 1/2005 | Franz | 52/698 |

* cited by examiner

INTEGRATED SHELF ALLOCATION MANAGEMENT SYSTEM

This application is a DIVISIONAL of application Ser. No. 11/846,355 filed Aug. 8, 2007, now U.S. Pat. No. 8,066,128.

BACKGROUND OF THE INVENTION

1. Field of the Invention

The present invention relates generally to systems for managing and allocating shelf space among rows of products. More particularly, the present invention is directed to integrated shelf allocation management systems with single and/or dual adjustability to accommodate varying shelf depths and varying product sizes easily.

2. Description of the Background

In retail stores, such as grocery stores, products are displayed on shelves for customers to inspect and select. In order to attract customers to a particular product and/or to facilitate a convenient shopping experience, these products must be organized in an orderly fashion on the store shelves. Moreover, because wasted shelf space wastes money, the products should efficiently use shelf space, even where disparate size shelves are utilized.

For orderly customer presentation, products may be divided into rows with dividers between rows so that each product row remains confined to a designated area and does not shift or cross over into another row. Further, these dividers may be adjustable in length so that they may accommodate varying shelf depths.

Additionally, vendors prefer to move the products to the front of the shelf so that the customer may easily view the products or reach them for purchase. If the products are hidden at the back of the shelf, the customer may not see or be able to reach them resulting in loss of potential sales. Display of the products in a disorderly fashion may also result in loss of sales.

Traditional shelving systems address one or more of these issues. One class of existing systems involves complex machinery which advances products to the front of the shelf using some type of biasing mechanism. Machines are limited to a specific shelf depth and are not easily adjusted to accommodate all shelving depths. Ultimately, these systems fail to maximize the use of store shelf space.

Other traditional systems involve less complex machinery, such as dividers that are separately attached to either the shelf itself or to locating strips that run lengthwise along the front of the shelf. Due to the separated nature of the dividers, these systems lack the structural stability of an integrated unit in which both side walls are joined by a base piece that runs therebetween. As a result, the dividers may fail to provide a rigid enough barrier to confine products to one particular row. Further, the permanent or semi-permanent nature of the attachment of the dividers to the shelf makes it difficult to reposition the dividers in these systems to accommodate varying product shapes and sizes. To accomplish such task, each divider is manually removed from either the shelf itself or a locating strip, repositioned, and reattached at a new position on the shelf or locating strip. That step can be both time consuming and inconvenient.

There has been a long standing need in the commercial vendor community for systems that allow for single and/or dual adjustability (width-wise and depth-wise) within an integrated unit to accommodate varying shelf depths and varying product sizes. Such a product would preferably maintain sufficient rigidity to align rows of products correctly.

SUMMARY OF THE INVENTION

In accordance with at least one preferred embodiment, the present invention provides apparatuses for the safe and efficient organization of product on shelves. In some embodiments, the present invention encompasses shelving allocation units that are adjustable in a longitudinal direction to accommodate varying shelf depths. In other embodiments, the present invention encompasses shelving allocation units that are adjustable in both the longitudinal direction, but also along an orthogonal axis. By being adjustable along an orthogonal axis, the shelving allocation units of the present invention may be adapted to accommodate various sizes of product.

The shelving allocation units may include multiple components. For the embodiments that are adjustable in the longitudinal direction, the shelving allocation units may be made up of at least two components. In these embodiments, two components preferably may be coupled together to form a shelving allocation unit with a base, at least two side walls, and barrier elements at the front and rear ends. The barrier element at the front of the assembly serves to block product from sliding forward off the shelf and the barrier element at the rear of the assembly acts to maintain product within the shelving allocation unit. The side walls serve to contain product within the shelving allocation unit. The two components are preferably coupled to one another so that the shelving allocation unit is adjustable along the longitudinal axis to accommodate varying shelf widths.

In other embodiments, the present invention includes four components that are adapted to be coupled to one another. In these embodiments, the four components together form the shelving allocation unit which will have a base, at least two side walls, and barrier elements at the front and rear ends. The four components are preferably adapted to couple to each other so that the entire assembly is adjustable along both the longitudinal direction (to accommodate varying shelf depths) and in the orthogonal direction (to accommodate various product sizes or product widths).

Whether adjustable in one or two dimensions, the embodiments of the present invention are preferably able to employ a backstop assembly. The backstop assemblies of the present invention allow customers and store personnel to draw product from the rear towards the front of the shelving allocation unit. The backstop assemblies of the present invention include a rear plate that engages the product, a base, and a puller member that is adapted to engage the front of the base of the backstop assembly. In some preferred embodiments, the puller assembly includes a central channel that is adapted to loosely accommodate the puller member. The front of the base may be engaged by the puller member when the backstop assembly is drawn towards the front of the shelf and may be designed to accommodate a variety of shelving depths.

BRIEF DESCRIPTION OF THE DRAWINGS

For the present invention to be clearly understood and readily practiced, the present invention will be described in conjunction with the following figures, wherein like reference characters designate the same or similar elements, which figures are incorporated into and constitute a part of the specification, wherein.

DETAILED DESCRIPTION OF THE INVENTION

It is to be understood that the figures and descriptions of the present invention have been simplified to illustrate elements that are relevant for a clear understanding of the invention, while eliminating, for purposes of clarity, other elements that may be well known. The detailed description will be provided herein below with reference to the attached drawings.

The present invention, through its use of an integrated unit made up of a base and side walls along with single and dual adjustability of this integrated unit addresses the limitations currently existing within the vendor community in order to provide a cost-effective integrated shelf allocation management system. Such a system preferably provides structural stability; can be easily placed on, moved, or removed from the shelf due to its integrated form; is quickly and easily adjustable to varying shelf depth and products shapes and sizes; and can efficiently advance products toward the front of the shelf for customer inspection and selection via the one or more preferred embodiments described herein.

As used herein, the "front" of the integrated shelf allocation management system refers to the portion resting on that part of the shelf surface closest to the aisle where a customer may easily view and/or select a product. The "rear" of the system refers to the portion resting of that part of the shelf surface farthest away from the aisle.

Figure 1:
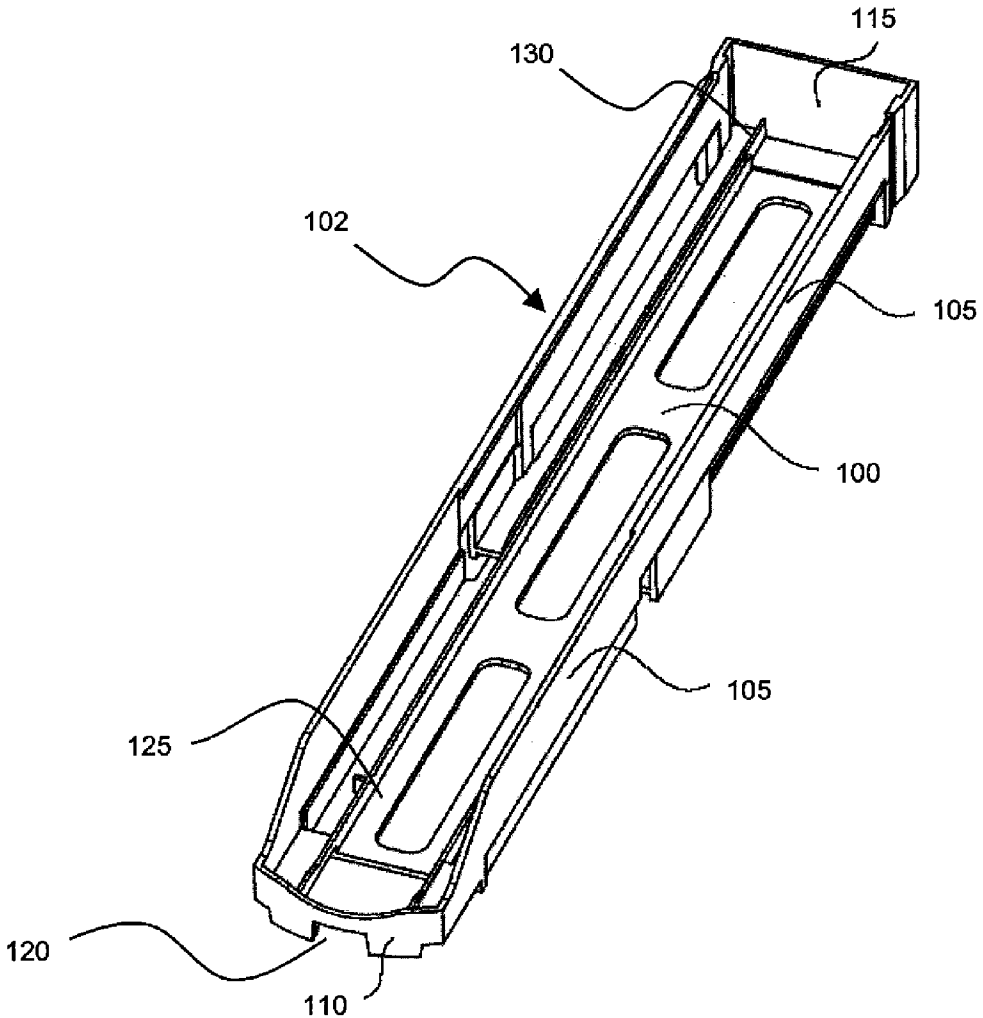
FIG. 1 is a perspective view of a first embodiment of the present invention in an unextended form.

FIG. 1 shows an embodiment of the integrated shelf allocation system according to the present invention in an unextended form as an integrated assembly 102. The integrated shelf allocation management system 102 allocates space along a retail store shelf among rows of product. The integrated shelf allocation management system 102 also provides for the movement of product toward the front of the shelf as described hereinbelow.

The integrated shelf allocation management system 102 of FIG. 1 generally includes a base 100 which runs along a longitudinal axis, at least two side walls 105, a front barrier element 110, and a rear barrier element 115. Each side wall 105 is located on opposing edges of the base 100 and extends vertically at approximately a 90 degree angle from the base 100. Side walls at a different angle may be used to accommodate various types of products. Any number of commonly available manufacturing techniques may be used to join the two adjacent side walls 105 to the base 100 to form an integrated unit. In certain presently preferred embodiments, the present invention includes a pair of raised rails 130 that may support product that is placed into the assembly 102. Together, those raised rails 130 define a central channel 125 into which a puller assembly may be placed as described in greater detail hereinbelow. In certain presently preferred embodiments, the central channel 125 leads to an opening 120 in which the puller assembly may be partial disposed.

The systems of the present invention form an integrated assembly 102 in which the side walls 105 are at least partially integrated with the base 100. Further, the size and shape of the shelf allocation system 102 is preferably telescopically adjustable depth-wise (front to back) to accommodate shelves of different depths as well as width-wise (to accommodate products of different widths).

As used herein, the term "telescopically" refers to the manner by which a side wall and a base extends or contracts within itself to allow such side wall and base to adjust either in a direction along a longitudinal axis or a direction along an orthogonal axis much as a telescope extends or contracts by the sliding of overlapping sections to vary its length.

As used herein, the term "integrated" means that the recited components remain selectably engaged as a single unit regardless of the chosen position. For example, when the shelf allocation management system is adjusted in a longitudinal direction (i.e., along the long axis of the device) to accommodate varying shelf depths, both the side walls 105 and base 100 are simultaneously extended in the same lengthwise direction. Although the side walls 105 and base 100 independently separate to accommodate this lengthwise extension, the base 100 and side walls 105 remain selectably engaged as one integrated unit.

The integrated unit arrangement of the side walls and base provides overall structural stability to the shelf allocation management system including, but not limited to, enhanced structural strength of the side walls to firmly hold the products in place within each row. Further, this integrated arrangement allows the shelf allocation management system to be easily placed on, moved, or removed from the shelf as one integrated unit.

Each side wall 105 forms a divider between product rows. This divider between product rows allows any individual row of product to be advanced on the shelf independent of any adjacent row of product while improving the utilization of the shelf width. The side wall 105 additionally prevents product damage from adjacent rows of products and also separates different types of products from one another.

FIG. 1 illustrates that a front barrier element 110 may be included at the front end of the integrated shelf allocation management system, thereby providing a physical stop to contain product within the assembly 102. Similarly, a rear barrier element 115 serves as a physical stop to prevent product from falling out of the rear of the assembly 102.

Products are preferably positioned between the side walls 105 and are supported on a segment of the base 100. When installed on top of existing shelving, the present invention preferably supports the product off of the shelf surface. By lifting the products off of the shelf, the present invention provides a greater degree of airflow underneath the products which may maintain a more uniform temperature within the product.

Figure 2:
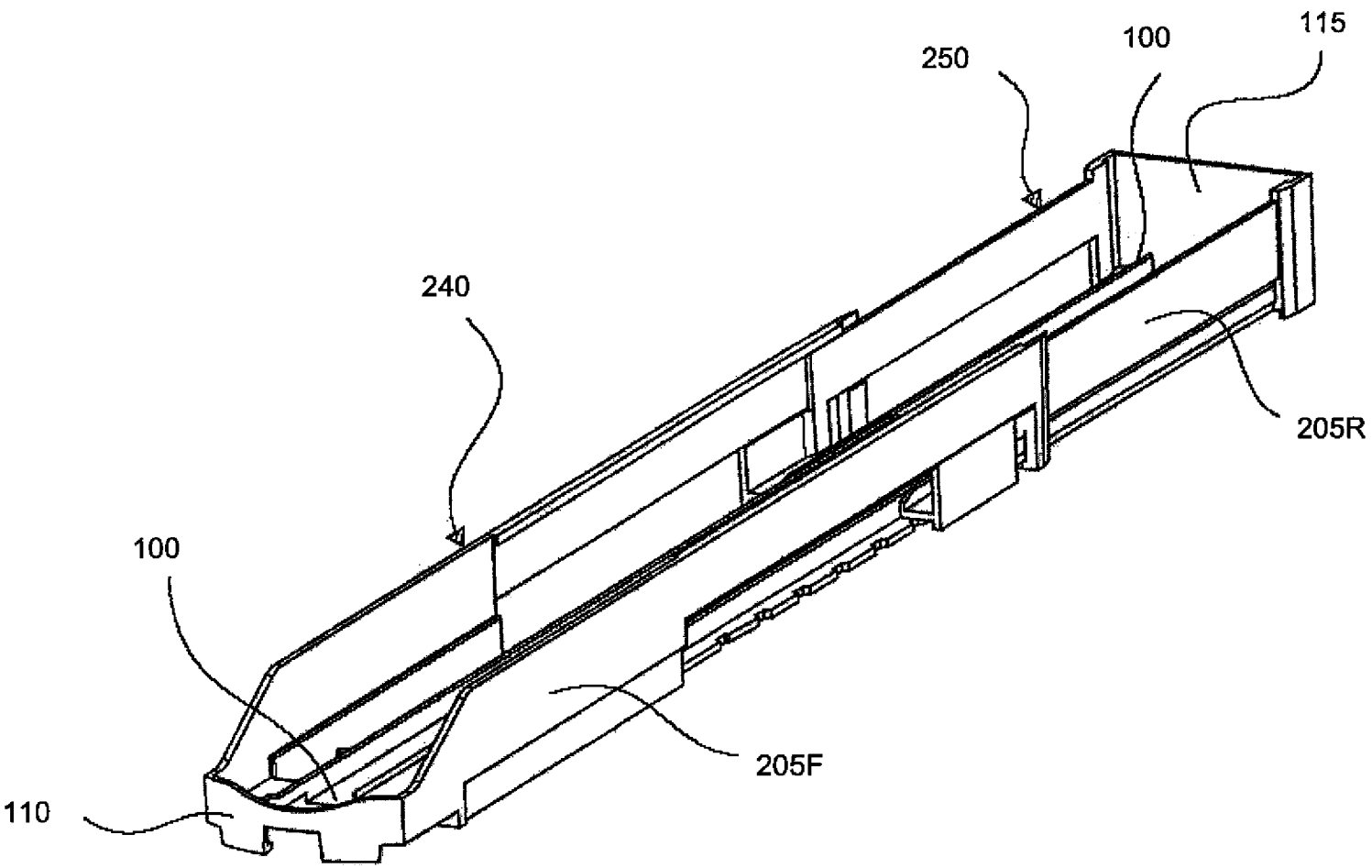
FIG. 2 is a perspective view of an embodiment of the present invention in an extended form.

FIG. 2 shows an integrated shelf allocation system according to one embodiment of the present invention in an extended position particularly display the multi-component nature of the present invention. As seen in this longitudinal extended view, the system includes a first component 240 and a second component 250, each component including a base 100 that runs along a longitudinal axis and at least two side walls 205F, 205R. The front component 240 also preferably includes a front barrier element 110. The rear component 250 preferably includes a rear barrier element 115. When selectively engaged, the two components 240, 250 form an integrated unit 102. The first component 240 is adapted to telescopically engage the second component 250 so that the system as a whole is telescopically adjustable to allow the assemblies of the present invention to accommodate varying depths of shelves.

As FIG. 2 illustrates, when the two components are engaged, they form an integrated assembly 102 adjustable along said longitudinal axis. As the integrated assembly is adjusted, the side walls 205F, 205R may be telescopically adjusted in a direction along the longitudinal axis and the base 100 may be simultaneously telescopically adjustable in the same direction as the side walls 205F, 205R. This one-dimensional adjustability feature allows the base 100 to extend or contract simultaneously with the two side walls 205F, 205R to accommodate varying shelf depths.

Figure 3:
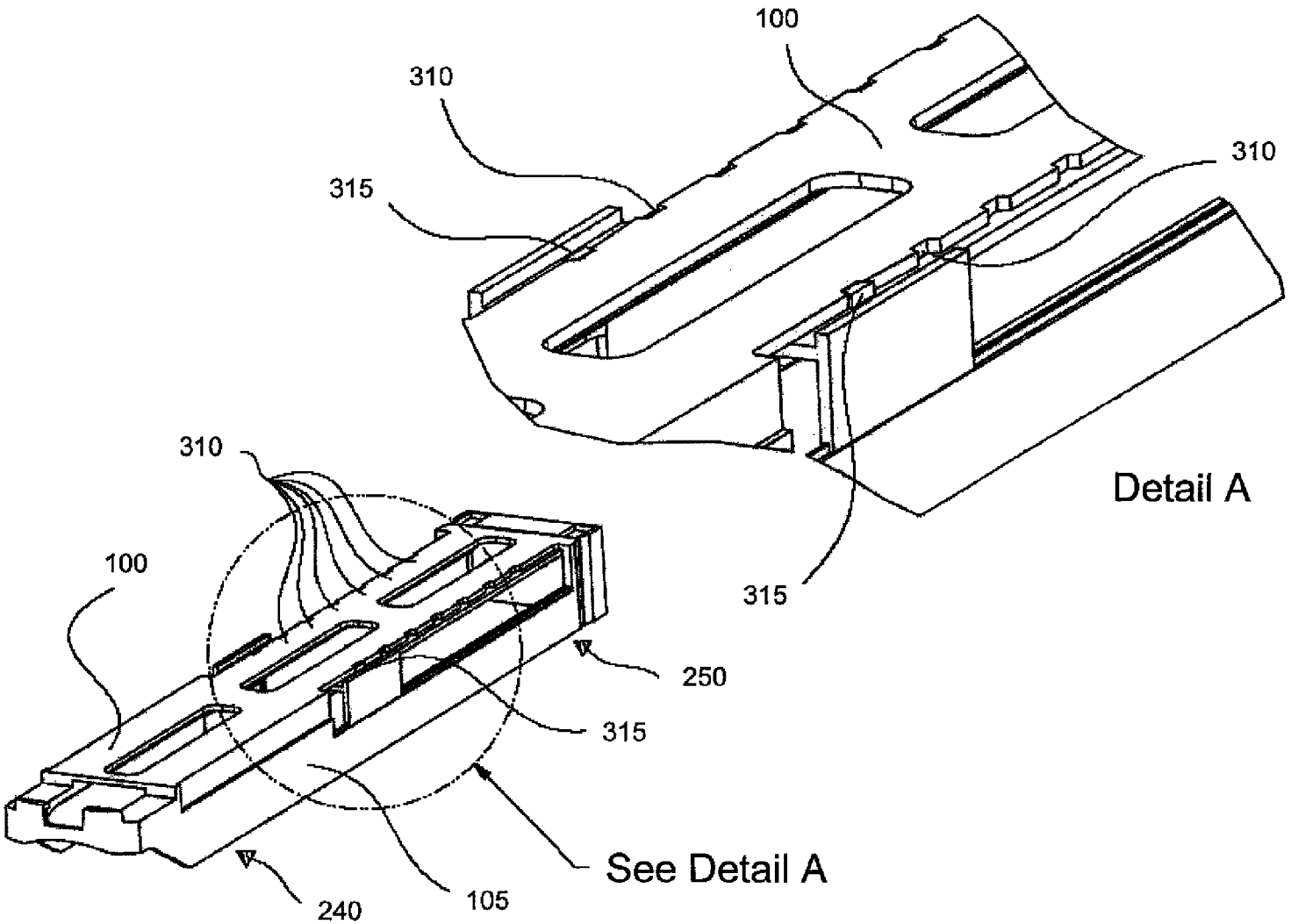
FIG. 3 shows an inverted view of an integrated shelf allocation system according to the present invention along with a blown-up view (FIG. 3A)

FIG. 3 illustrates an inverted view of an integrated shelf allocation system according to the present invention along with a blown-up view (FIG. 3A). As an example of selectable telescopic engagement between the first component 240 and second component 250, FIGS. 3 and 3A illustrate stop indications 310 located at regular intervals along a segment of at least one side of the base 100. FIGS. 3 and 3A also illustrate protruding tapered rectangles or squares 315 designed to compliment (in both size and shape) the stop indications 310, though other markers or indications may be used. The stop indications 310 and protruding tapered rectangles or squares 315 preferably provide a manner for setting the length of the side wall and lock the side wall into place by snapping into a chosen position. The stop indications 310 and protruding tapered rectangles or squares 315 may be found on one or both of the two adjacent side walls. If they are found on only one of the side walls, adjusting one side wall through use of these structures simultaneously adjusts the other adjacent side wall and the base as the base and two adjacent sidewalls form one integrated unit.

As shown in FIG. 3A, the stop indications 310 and protruding tapered rectangles 315 provide a mechanism for setting the length of the base 100 appropriately for the shelf on which the present invention is placed. The stop indications 310 and raised rectangles 315 together form a coupling mechanism by which the front component 240 is coupled to the rear component 250. One of skill in the art will recognize other mechanisms and techniques that may be employed for the selective coupling of the two components.

Figure 4:
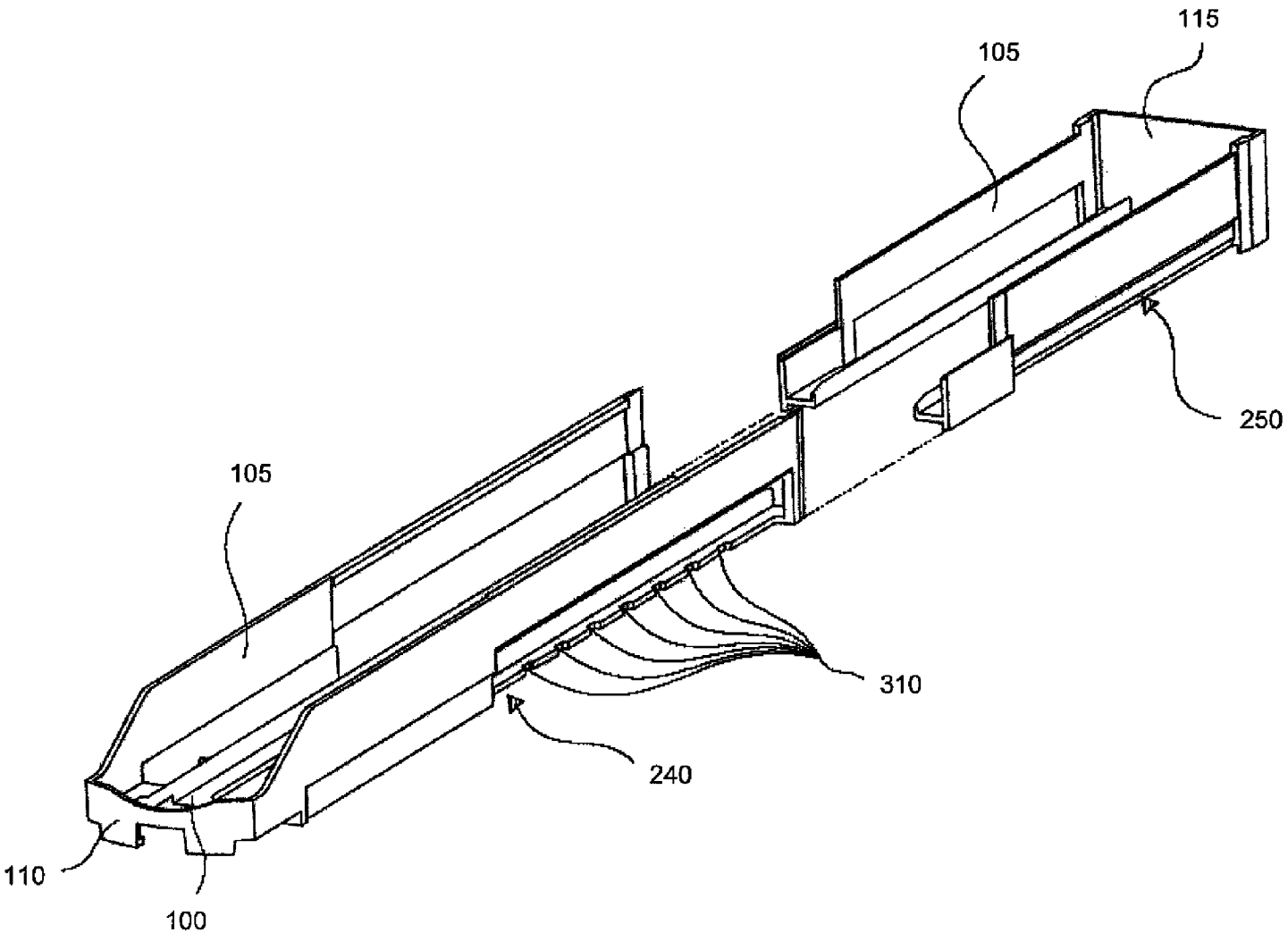
FIG. 4 illustrates how the first component and second component of the integrated shelf allocation system according to the present invention fit together.

FIG. 4 illustrates how, in one preferred embodiment, the first component 240 and the second component 250 engage to enable telescopic adjustment in a direction along the longitudinal axis.

In another embodiment, the integrated shelf allocation management system of the present invention may be adjustable in both the longitudinal and orthogonal directions. While the embodiments of the present invention that are adjustable in one dimension are comprised of two components, the embodiments of the present invention that are adjustable in two dimensions are preferably comprised of four components. As described and shown herein, two components are adapted to be coupled to one another and form the front portion of the overall assembly. Two additional components form the rear of the overall assembly.

Figure 5:
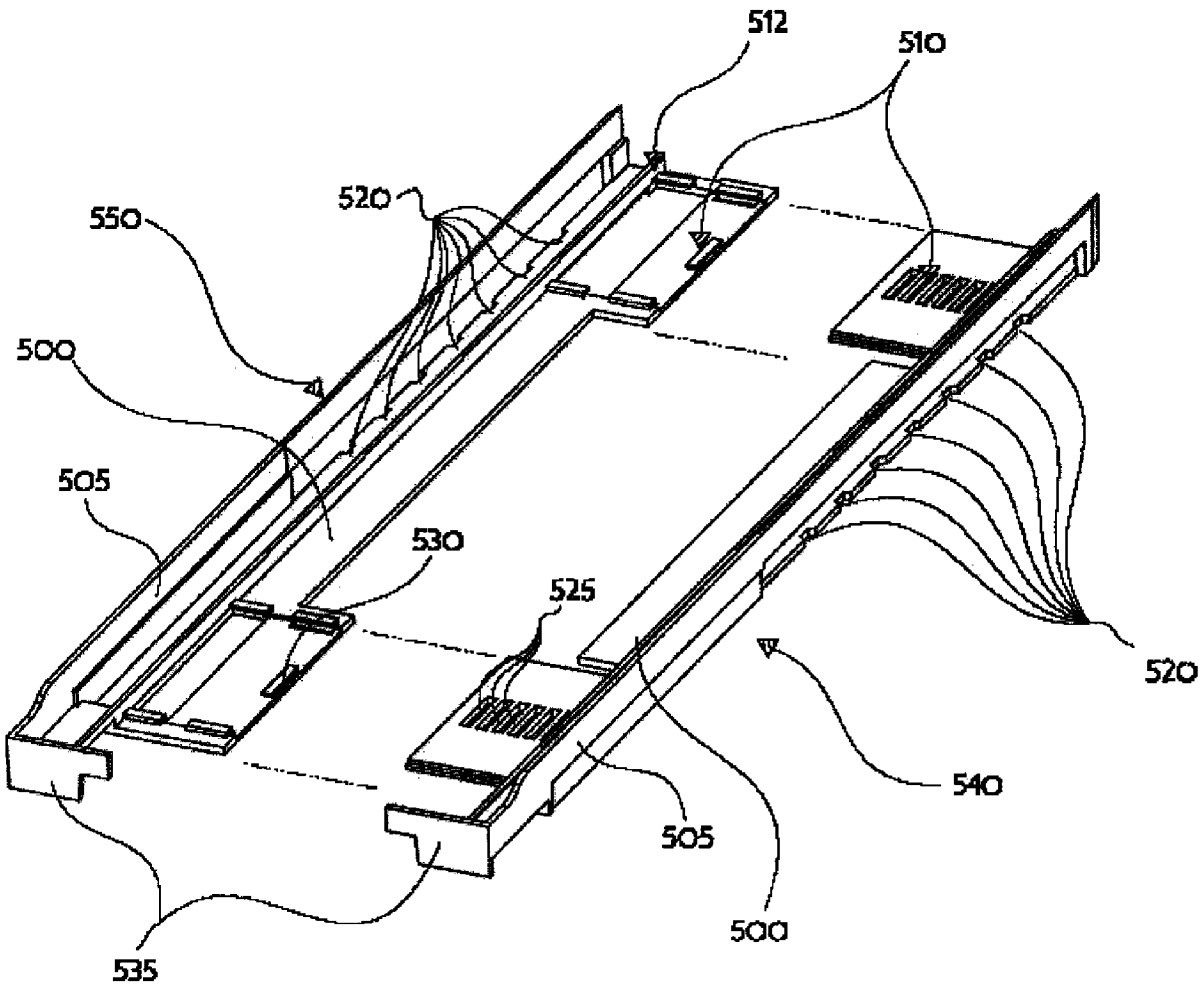
FIG. 5 shows a perspective view of an alternative embodiment of the present invention illustrating how the first component and second component fit together.

The two components that form the front of the overall assembly are shown in FIG. 5 which highlights the adjustability along the orthogonal axis. FIG. 5 shows a first component 540 and a second component 550 of the system, and how these components telescopically engage with one another via coupling mechanisms to form an integrated assembly. Each component includes a base 500 which runs along a longitudinal axis, a side wall 505 located on an exterior edge of said base, and a front barrier element 535. The first component 540 and second component 550 (here shown on the left- and right-hand side respectively) may be coupled to form an integrated unit having a base 500 and side walls 505 for the containing of product. The second component 550 may be a mirror image of the first component 540 in that the second component 550 has a longitudinal axis parallel to the first component 540 and an orthogonal axis parallel to the first component 540. FIG. 5 further illustrates a barrier element 535 at the front of the integrated assembly, thereby providing a physical stop that contains product within the assembly of the present invention.

FIG. 5 further illustrates how a coupling mechanism 510 of the base 500 of the second component 550 is adapted to telescopically engage the first component 540 to form an integrated assembly which is adjustable in a direction along the orthogonal axis to accommodate products of varying widths. Stop indications 525 and a raised rectangle 530 adapted to engage the stop indications 525 at regular intervals along at least a segment of the base portions of two components. Together, the stop indications 525 and raised rectangles 525 make up a coupling mechanism 510 that allows the first two components to form an integrated unit. The stop indications 525 and raised rectangles 530 provide a manner for setting the distance between the first and second side walls 505 by locking the base 500 into place by selectably snapping a raised rectangle 530 into the stop indications 525 at a chosen position. One of skill in the art will recognize numerous other types of coupling mechanisms such as clasps, sliders, latches, etc. that may be used within the context of the present invention.

Figure 6:
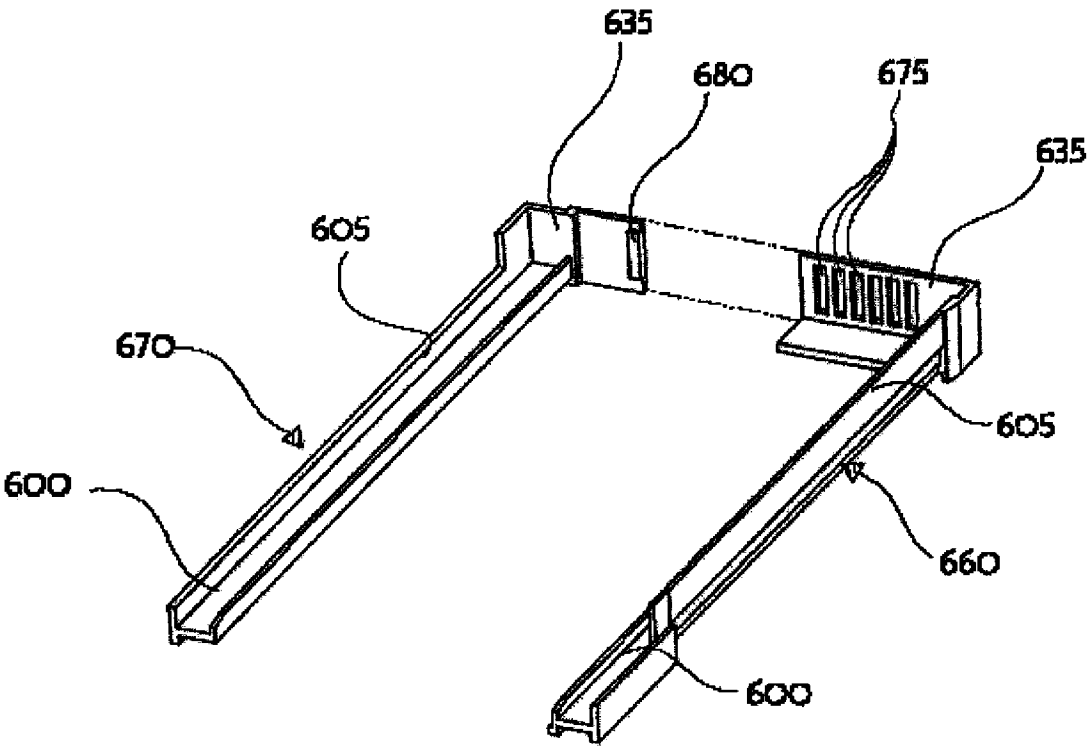
FIG. 6 illustrates a perspective view of an alternative embodiment of the present invention illustrating how the third component and the fourth component fit together.

FIG. 6 shows the third component 660 and fourth component 670 of the presently preferred embodiment of the system which forms the rear portion of the overall assembly. The third 660 and fourth 670 components preferably are preferably adjustable along both the longitudinal and orthogonal axes. Each component includes a base 600 which runs along a longitudinal axis, a side wall 605 located on an exterior edge of the base, and a barrier element 635 located at the rear of the component and thus the rear of the assembly. In the embodiment show in FIG. 6, the barrier element 635 of the third and fourth components also includes a coupling mechanism that allows the two components to lock together and form part of the integrated unit.

Specifically, FIG. 6 illustrates how the fourth component 670 is adapted to telescopically engage the third component 660 via the coupling mechanism (together, elements 675 and 680). The coupling mechanism preferably includes stop indications 675 and a raised rectangle 680 that is adapted to engage the stop indications 675 at regular intervals. The stop indications 675 and the raised rectangle 680 provide a manner for setting the distance between the third and fourth side walls 605 that corresponds to the distance chosen between the first and second components 540, 550 in FIG. 5. One of skill in the art will recognize numerous other types of coupling mechanisms such as clasps, sliders, latches, etc. that may be used within the context of the present invention.

Figure 7:
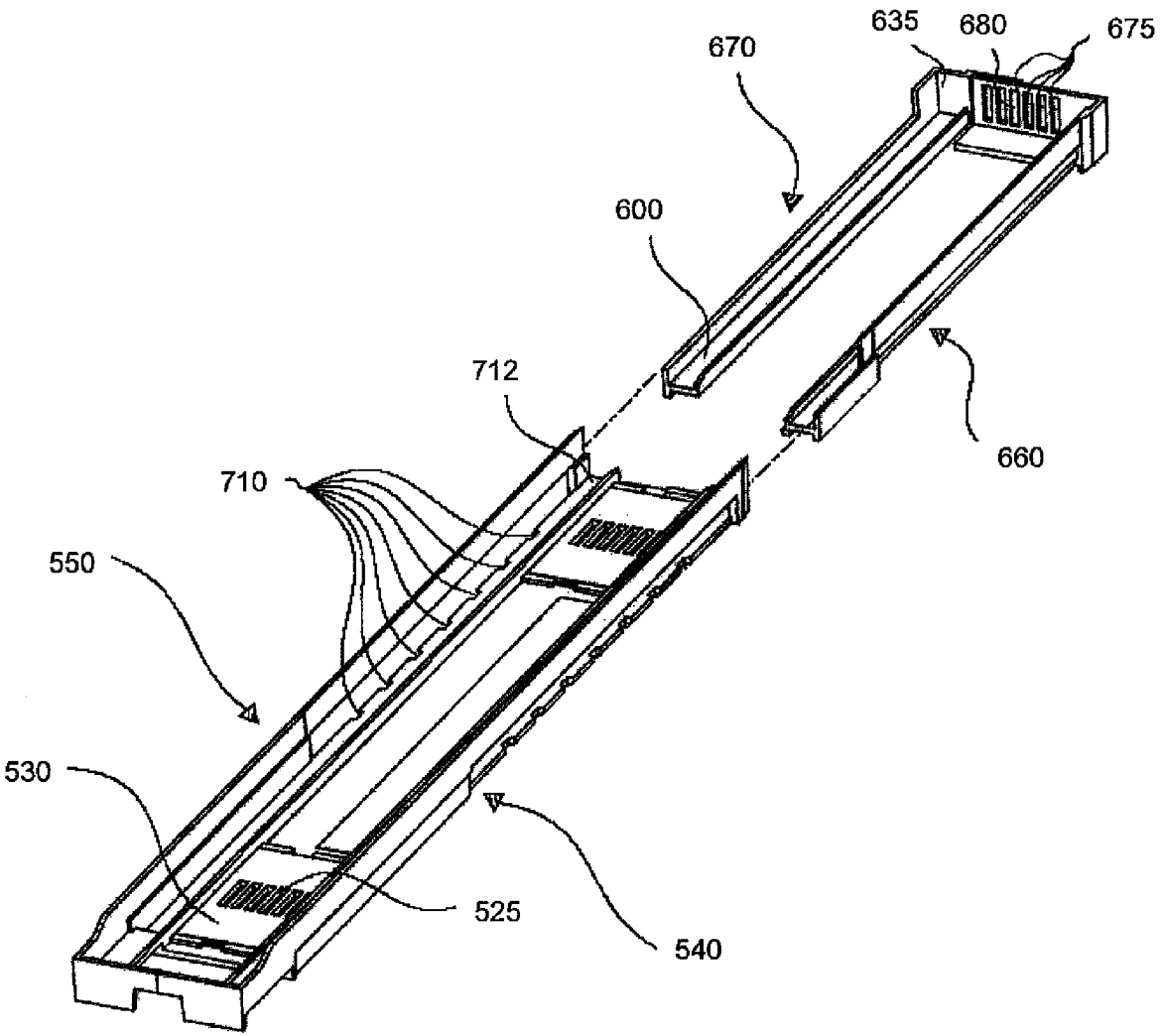
FIG. 7 shows a perspective view of an alternative embodiment of the present invention illustrating how the first component and third component fit together and how the second component and fourth component fit together.

FIG. 7 illustrates how all four components are joined to form the overall assembly. The third component 660 is adapted to telescopically engage the first component 540. Similarly, the fourth component 670 is adapted to telescopically engage the second component 550. As such, the rear portion of the overall assembly is comprised of the third and fourth components which selectively engage the complimentary portions of the first and second components. Specifically, the base of the third component 600 may be disposed into the first track 512 of the first component 540. Similarly, the base of the fourth component 600 may be disposed in the track 512 of the second component 550. The two rear components are able to slide in the longitudinal axis along the tracks, thus adjusting the length of the assembly in the longitudinal direction. By adjusting coupling mechanisms 525, 530 and 675, 680, the overall width of the assembly may be adjusted.

A backstop assembly 800 may be positioned between the side walls in any embodiment of the present invention as described. The backstop assembly 800 is moveable along the longitudinal axis of the assembly and is adapted to engage and advance a row of products within the shelving unit. The backstop assembly 800 shown in FIG. 8 may be used by customers as well as store personnel to pull products from the rear of an integrated shelf assembly of the present invention towards the front. This style of backstop would allow customers and store personnel to obtain product that they might otherwise be unable to reach or see in the rear of the shelf. The backstop assembly 800 may run on tracks located on the base of the assembly (see, e.g., 130), thereby allowing the backstop assembly 800 to be smoothly drawn towards the front of the assembly.

Figure 8:
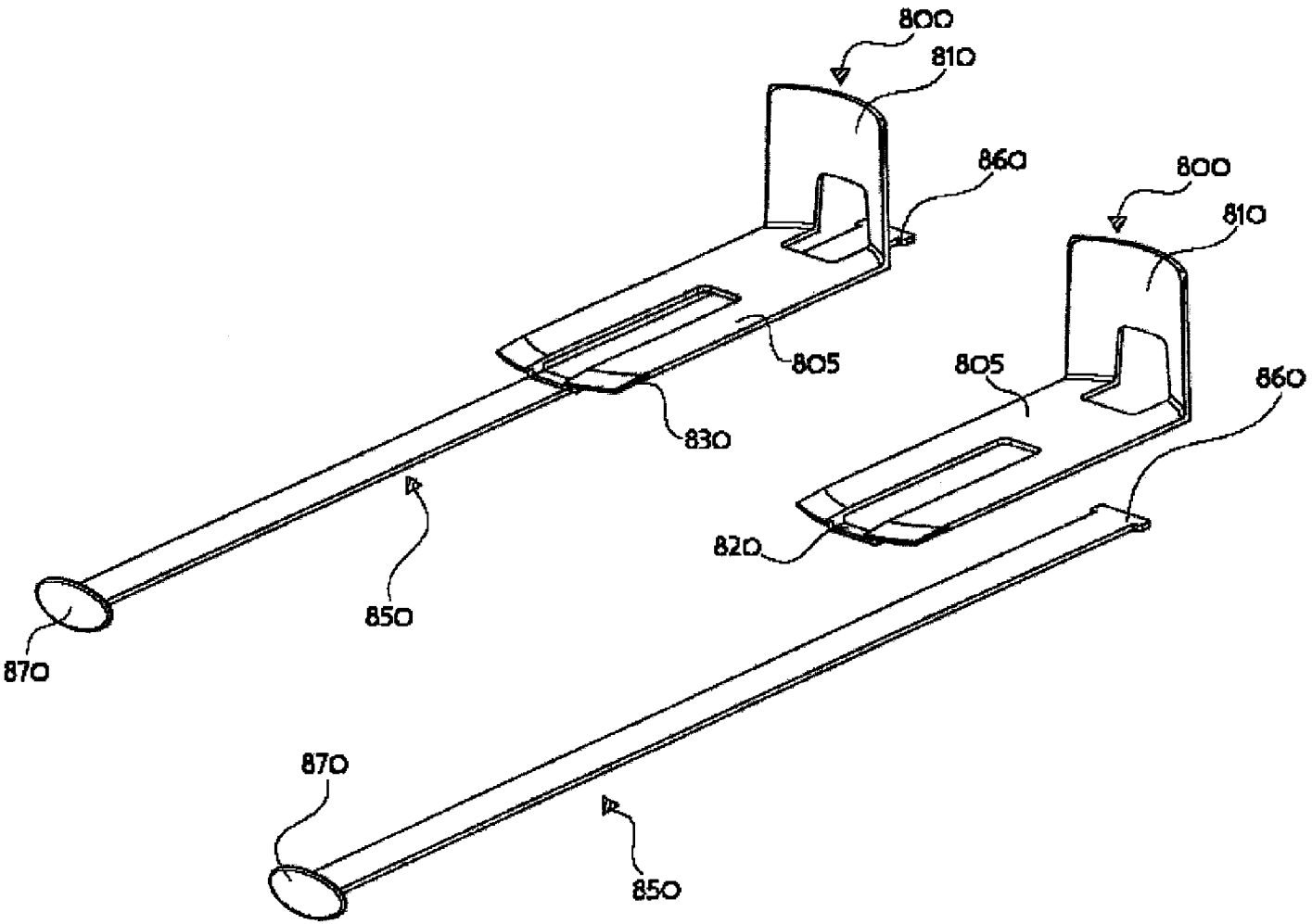
FIG. 8 illustrates a perspective view of an embodiment of the backstop assembly of a presently preferred embodiment of the present invention.

FIG. 8 illustrates the structure of the backstop assembly 800 and its relationship to the puller member 950. The backstop assembly includes a backstop base 805 and a backstop plate 810. As shown in FIG. 8, these two elements are fabricated as a single piece. In other presently preferred embodiments, these two elements may be made up of two separate pieces of material that are fused or glued together at a later time. In some embodiments, the backstop assembly 800 includes ribs (not shown) on the underside of the backstop base 805 that stabilize the backstop assembly against rotation, thereby improving the ability of the backstop assembly to draw product towards the front of the shelving unit.

A central backstop channel 820 is present at the front of the backstop base 805 to accommodate the puller member 850. The puller member 850 is appropriately sized so as to move forwards and backwards through the central backstop channel 820 with limited restriction. The rear end of the puller member includes an engaging portion 860 which is preferably larger than the central backstop channel 820 such that the engaging portion 860 engages the front portion of the backstop assembly 800 to move the backstop assembly 800 forward. The engaging portion 860 is large enough in size so as to not dislodge from the backstop assembly 800 while it is moving the backstop assembly toward the front of the shelving allocation unit. As shown, the puller member 850 engages the backstop assembly 800 in its front portion 830, thereby allowing the puller member 850 and backstop assembly 800 to have an effective reach that approximates the entire length of the backstop assembly 800 plus the puller member 850. In addition, the front portion 830 of the backstop assembly preferably is slightly angled forward to form a ramp. That ramp allows product to transition easily from the base of the shelving allocation unit to the base of the backstop 805.

In some preferred embodiments, a gripping element 870 is secured to the front end of the puller member 850. A variety of gripping elements may be attached to the front of the puller member. This gripping element 870 may be fashioned in various manners, including a simple hole, a knob, or an upturned portion of the puller member, convenient for grasping with the fingers. The gripping element 870 may also include an advertisement or instructions for the customer (e.g., "Pull Here"). This puller member could also be implemented using other commonly known structures.

Figure 9:
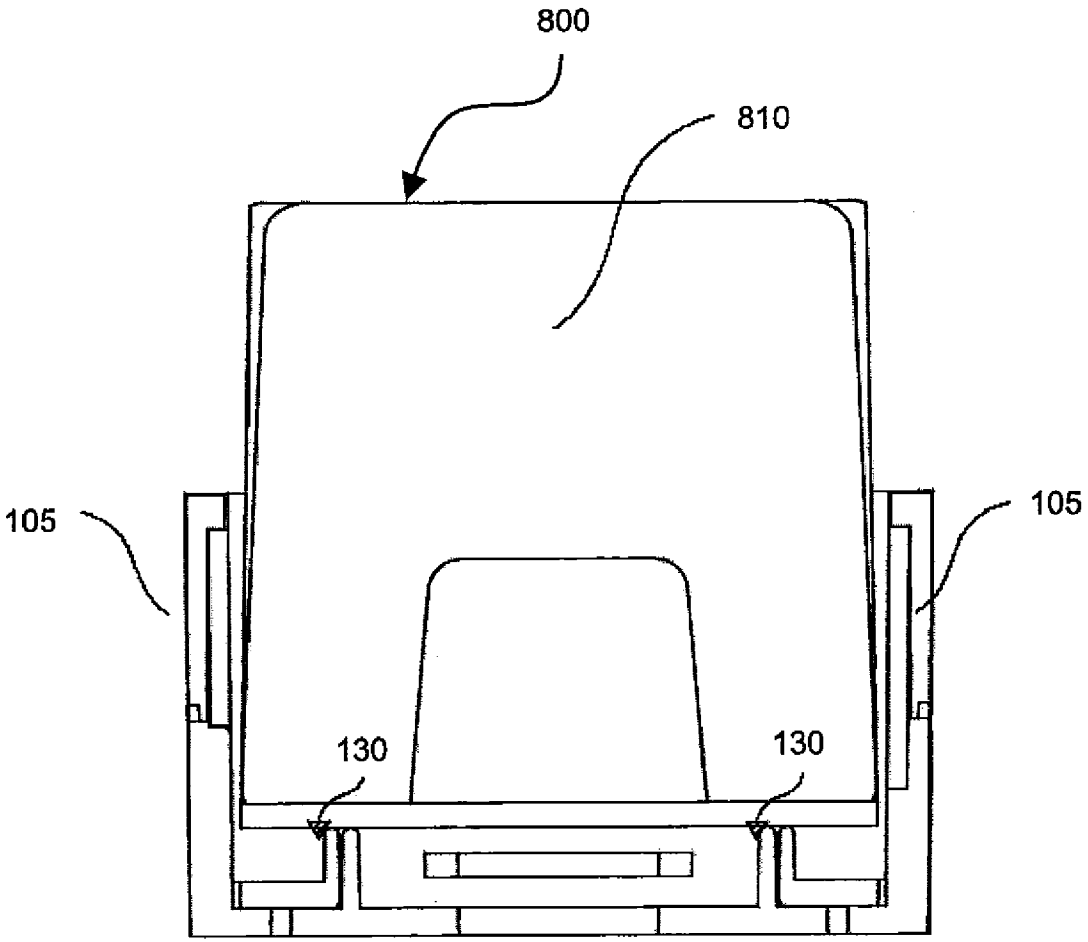
FIG. 9 illustrates a rear view of an embodiment of the backstop assembly of a presently preferred embodiment of the present invention including the rear of the backstop plate and the bottom side of the backstop base.

FIG. 9 illustrates a cross-sectional view of an embodiment of the backstop assembly 800 placed into a shelving allocation unit of the present invention. More specifically, FIG. 9 illustrates raised tracks 130 located on the bottom side of the shelving allocation unit base that prevent the backstop assembly 800 from moving side to side as it is moved in the longitudinal direction. In the present embodiment, the bottom side of the shelving assembly base includes multiple channels 130 that guide the direction that the backstop assembly may slide. Such channels and ridges are included in some presently preferred embodiments, though other presently preferred embodiments omit these elements and allow the backstop assembly 800 to slide freely within the shelving allocation unit.

Figure 10:
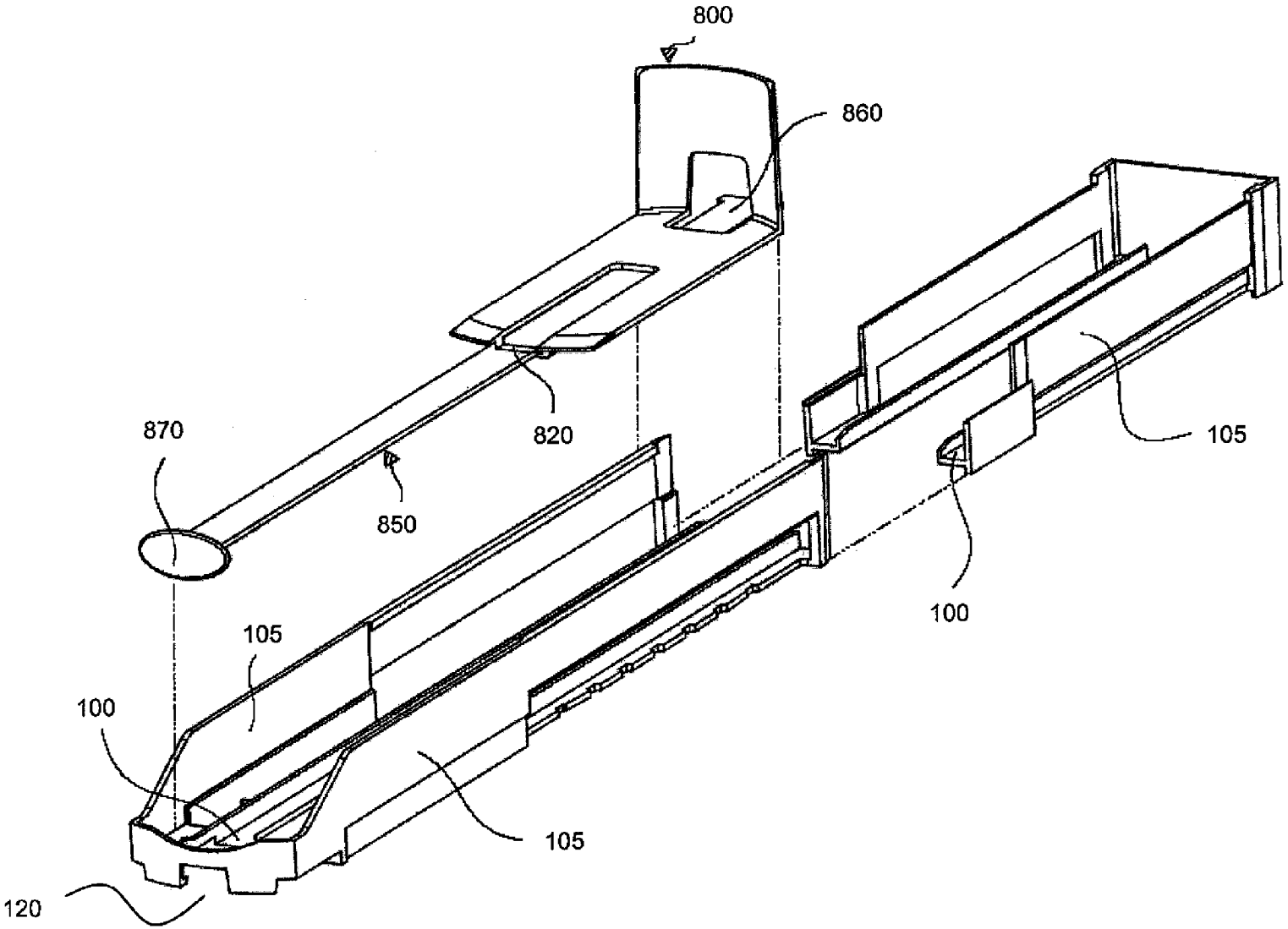
FIG. 10 shows a perspective view of an embodiment of the backstop assembly (including puller member) incorporated into any of the embodiments of the present invention such that products of varying dimensions may be advanced to the front of the shelf.

FIG. 10 shows how the backstop assembly 800 (including puller member 850) as illustrated by FIG. 8 may be incorporated into any of the embodiments of the present invention such that products of varying dimensions may be advanced to the front of the shelf. Other embodiments of backstop assemblies useful within the context of the present invention may be found in U.S. Pat. No. 5,469,976, which is hereby incorporated by reference.

In certain preferred embodiments, the puller member 850 resides within a central channel 125 that runs down the middle of the longitudinal axis of the shelving allocation unit. That location of the puller allows the product to rest above the central channel 125, thus further allowing the product to slide easily along the center of the shelving allocation units of the present invention.

As the products are removed from the row, the store customer or store personnel will advance the row of products towards the front of the assembly by moving the puller member 850 towards the front of the assembly using the gripping element 870. As the puller member 850 is advanced towards the front of the assembly, the engaging portion 860 may be abutted against the central backstop channel 820 engaging the backstop assembly 800 to advance the row of products towards the front of the assembly. Once that step has been accomplished, the customer or stock person may then push the puller member 850 towards the rear of the assembly using the gripping element 870. Because the puller member 850 is only slideably related to the backstop assembly 800 through the central backstop channel 820, in its backward movement the puller member 850 will experience minimal resistance from either the backstop assembly 800 or from the products. Thus, the puller member 850 may be pushed backward without disturbing the backstop assembly 800 or the products until the puller member 850 is conveniently stowed.

This process may be repeated as often as needed until the row of products is exhausted. When the row of products has been exhausted or when restocking is necessary, the backstop assembly 800 can be manually pushed toward the rear of the assembly and new products inserted. The present invention may also include a bias mechanism, such as a spring-based mechanism, by which the backstop assembly 800 may be automatically drawn toward the front of the assembly as product is withdrawn from the unit. One of ordinary skill in the art will recognize multiple manners in which such a bias mechanism could be implemented.

A further advantage of the shelving allocation units of the present invention includes the ability of store personnel to restock shelves with product from the front of the shelf. Specifically, store personnel may place the product in the front of the shelving allocation unit and push back earlier-stocked product towards the rear, thus avoiding awkward reaching to the rear of shelves during typical restocking.

Figure 11:
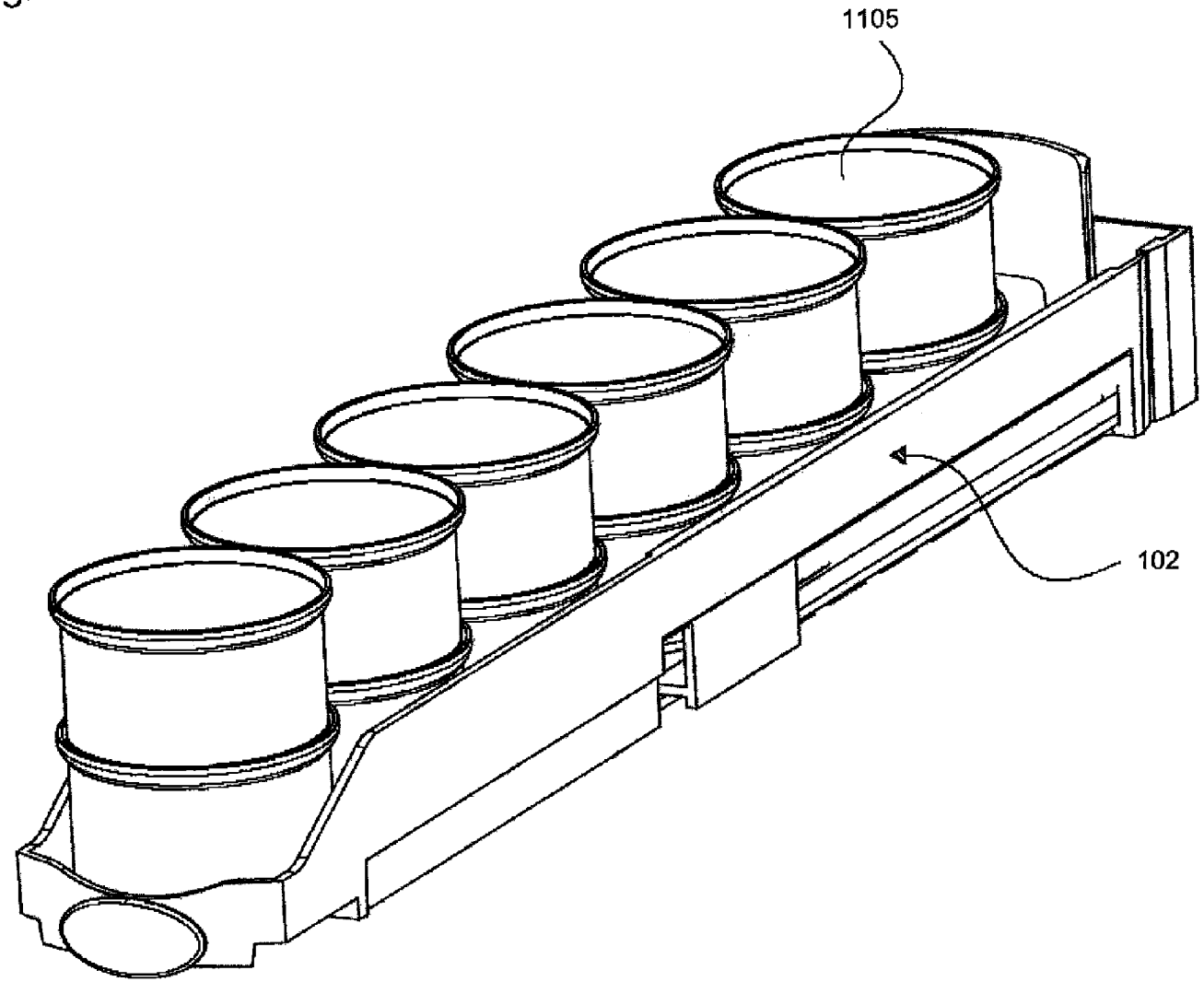
FIG. 11 illustrates a perspective view of products positioned on an integrated shelf allocation system of the present invention.

FIG. 11 illustrates how cans of product 1105 may be positioned on an integrated shelf allocation system 102 of the present invention. FIG. 11 also illustrates an additional benefit of the present invention. As displayed, the shelving allocation unit of the present invention 102 fully contains an entire row of product. In certain embodiments, the shelving allocation unit 102 is fabricated from a material that is rigid enough to support the entire row of product 1105. Accordingly, if store personnel are required to move the location of the product within the store, they merely pick up the entire shelving allocation assembly 102 without removing product 1105 from the assembly. This property saves store personnel a tremendous amount of time during reorganization of store shelving.

Figure 12:
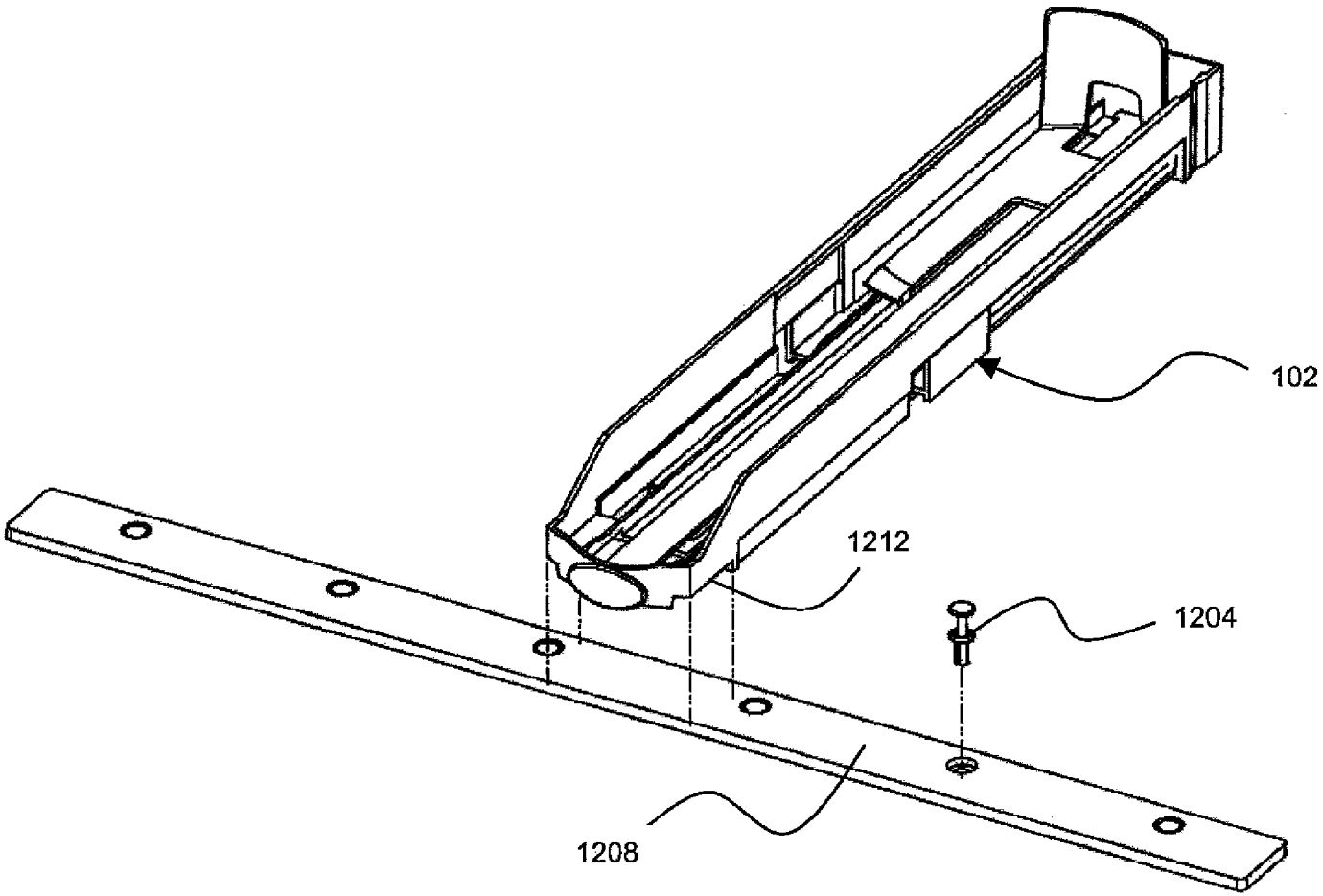
FIGS. 12 and 13 display embodiments of the present invention interacting with a lock-on strip to be secured to the shelving surface.

In addition to the components shown and described hereinabove, the present invention may also include a mechanism by which the integrated shelf allocation system may be secured to the shelf. In FIG. 12, a shelving allocation unit of the present invention 102 is secured to the shelf via a lock-on strip 1208. The lock-on strip 1208 is secured to the shelf via push pins 1204 or other securing devices. The lock-on strip 1208 is adapted to fit snugly into a groove 1212 in the front portion of the shelving allocation unit 102.

Figure 13:
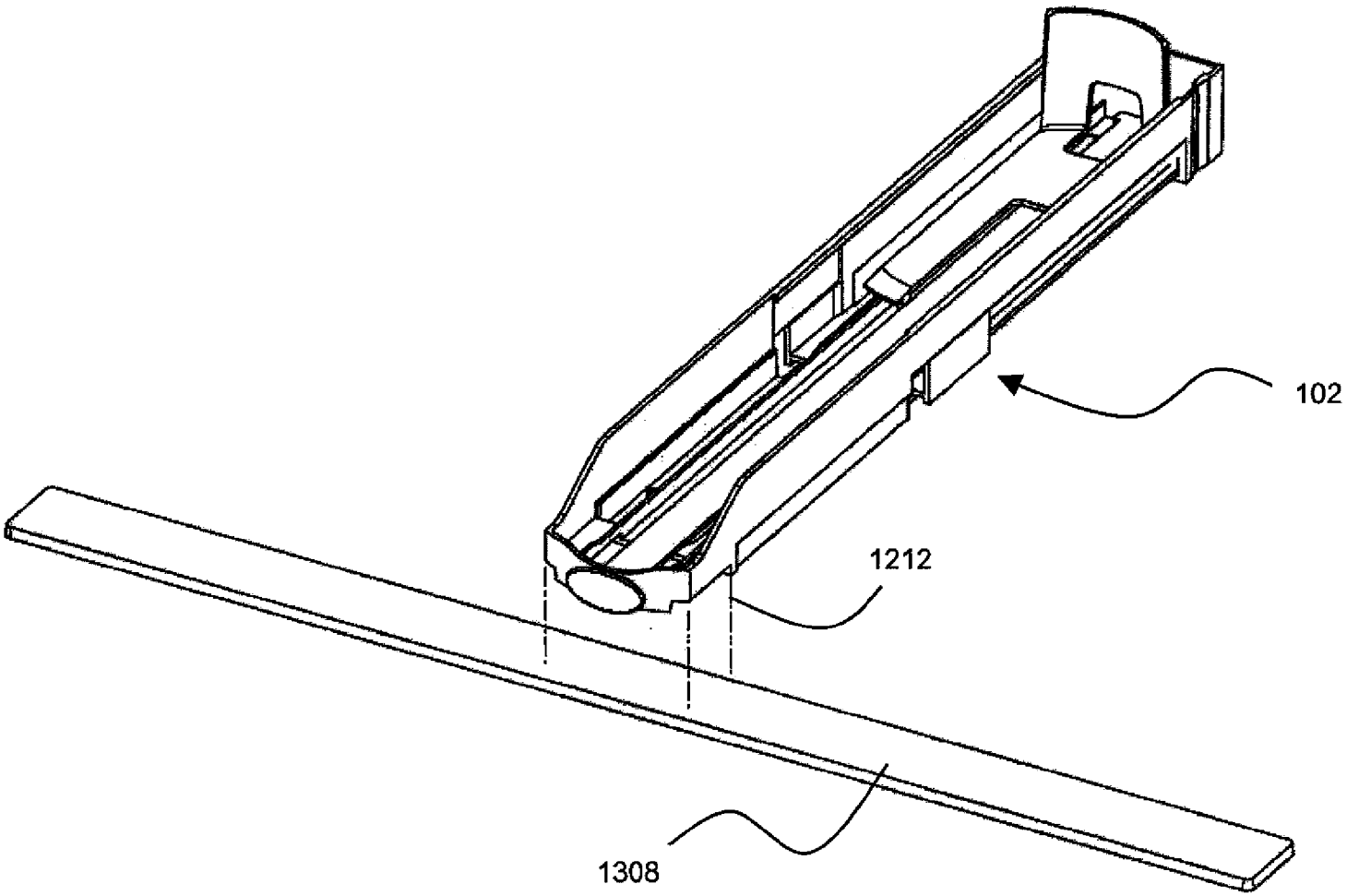

Similarly, FIG. 13 displays another type of lock-on strip 1308 which is secured to the shelf via double-sided tape. The groove 1212 in the front of the shelving allocation unit 102 is adapted to snugly fit the lock-on strip 1308 and prevent the shelving allocation unit 102 from sliding longitudinally on the shelf, thereby improving safety and improving utility in a commercial context.

Additionally, the side walls of any embodiment of the present invention may be adjustable to achieve varying heights such as by snap-on type extension to accommodate products of varying heights. Additionally, score marks may be provided on the side walls to allow for a portion of the side walls to be broken off so that the height of the side walls can be adjusted as appropriate for the shape and size of the product in the row of products. The present configuration allows one mold or manufacturing technique to produce a variety of heights of side walls.

Additionally, score marks may be provided on the backstop plate of the backstop assembly. The scores marks allow for a portion of the backstop plate to be broken off so that the height of the backstop plate can be adjusted as appropriate for the shape and size of the product in the row of products. The present configuration allows one mold or manufacturing technique to produce a variety of heights of backstop plates. Furthermore, markings may be provided on the puller member to indicate the space remaining on the shelf when the products are advanced to the front as an aid for restocking or inventory purposes.

Other uses for the present invention may be contemplated. For example, the present invention may accommodate products in a variety of shapes and sizes such as jars, bottles, boxes, barrels and drums.

Nothing in the above description is meant to limit the present invention to any specific materials, geometry, or orientation of elements. Many part/orientation substitutions are contemplated within the scope of the present invention and will be apparent to those skilled in the art. The embodiments described herein were presented by way of example only and should not be used to limit the scope of the invention.

Although the invention has been described in terms of particular embodiments in an application, one of ordinary skill in the art, in light of the teachings herein, can generate additional embodiments and modifications without departing from the spirit of, or exceeding the scope of, the claimed invention. Accordingly, it is understood that the drawings and the descriptions herein are proffered only to facilitate comprehension of the invention and should not be construed to limit the scope thereof.

What is claimed is:

1. A shelf allocation management system for allocating space among rows of products, comprising: a base, two side walls, a front end, and a rear end; a backstop assembly positioned between said side walls, the backstop assembly comprising:

a backstop base, wherein said backstop base includes two parallel arms at a front end of said backstop base that define a central backstop opening that runs longitudinally through the backstop base and centrally within said backstop base, wherein said backstop base further includes a lower ledge below said parallel arms and connected to a front portion of said parallel arms at the front end of said backstop base;

a moveable back plate located at a rear end of said backstop base wherein the back plate has a product-engaging surface; and a puller member having a longitudinal axis, wherein said puller member is disposed within said central backstop opening and is configured to move the moveable back plate by engaging said backstop base at said lower ledge.

2. The shelf allocation management system of claim 1, wherein said puller member further comprises at least one tab disposed in a direction transverse to the longitudinal axis of the puller member at a rear end of said puller member, said at least one tab having a width that allows said puller member to engage said lower ledge.

3. The shelf allocation management system of claim 2, wherein said puller member further comprises a gripping element at a front end of said puller member wherein the gripping element is configured to be gripped by a user to move the puller member and moveable back plate in a direction parallel to the longitudinal axis of the puller member.

* * * * *